US009566496B1

(12) United States Patent
Mallett

(10) Patent No.: US 9,566,496 B1
(45) Date of Patent: Feb. 14, 2017

(54) RACQUET GRIP TEACHING DEVICE

(71) Applicant: Peter E. Mallett, Kaysville, UT (US)

(72) Inventor: Peter E. Mallett, Kaysville, UT (US)

(73) Assignee: Peter Mallett, Kaysville, UT (US)

( * ) Notice: Subject to any disclaimer, the term of this patent is extended or adjusted under 35 U.S.C. 154(b) by 0 days.

(21) Appl. No.: 14/704,250

(22) Filed: May 5, 2015

Related U.S. Application Data

(60) Provisional application No. 62/050,458, filed on Sep. 15, 2014.

(51) Int. Cl.
*A63B 69/38* (2006.01)
*A63B 49/08* (2015.01)
*A63B 59/00* (2015.01)

(52) U.S. Cl.
CPC ..... *A63B 69/38* (2013.01); *A63B 49/08* (2013.01); *A63B 59/0025* (2013.01)

(58) Field of Classification Search
CPC ..... A63B 69/38; A63B 49/08; A63B 59/0025
See application file for complete search history.

(56) References Cited

U.S. PATENT DOCUMENTS 3,817,521 A 6/1974 Wright
3,868,110 A 2/1975 Jones
4,664,381 A 5/1987 Aaron
4,759,546 A 7/1988 Steele, Jr.
5,588,651 A * 12/1996 Frost ..... B25G 1/102 2/20
6,213,902 B1 4/2001 Hagey et al.
6,419,601 B1 * 7/2002 Kenner ..... A63B 49/08 16/430
6,916,260 B1 7/2005 Poteet
7,160,216 B2 1/2007 Failla Colonnello Seppi et al.
7,276,000 B1 10/2007 Baker
7,758,455 B2 7/2010 Thomas
7,896,762 B2 3/2011 Schroeder
(Continued)

FOREIGN PATENT DOCUMENTS

DE 3202194 A1 8/1983
GB 190817501 A 4/1909
(Continued)

OTHER PUBLICATIONS

Perfek, Vector Studios, p. 1, Feb. 7, 2014.

*Primary Examiner* — Gene Kim
*Assistant Examiner* — Jeffrey Vanderveen
(74) *Attorney, Agent, or Firm* — Atlas Intellectual Property Law; Travis Banta

(57) ABSTRACT

A racquet grip teaching device including a top clasp having five faces shaped and orientated to mate with a tennis racquet handle. The top clasp includes exactly five faces. The racquet grip teaching device includes a finger connector extending downwardly from the top clasp at a first end region of the top clasp. The device includes a finger guide disposed at an end of the finger connector, opposite of the top clasp, and shaped to receive a finger. The racquet grip teaching device includes a thumb connector extending downwardly from the top clasp at a second end region, opposite of the first end region. The teaching device includes a thumb guide disposed at an end of the thumb connector, opposite the top clasp, and shaped to receive a thumb.

3 Claims, 10 Drawing Sheets

(56) References Cited

U.S. PATENT DOCUMENTS

| | | | | |
|---|---|---|---|---|
| 8,602,925 | B1 | 12/2013 | Rickon, Jr. | |
| 2009/0011875 | A1 | 1/2009 | Drake et al. | |
| 2010/0056309 | A1 | 3/2010 | Aida | |
| 2014/0194230 | A1 * | 7/2014 | Lazarov ..... | A63B 49/08<br>473/551 |

FOREIGN PATENT DOCUMENTS

| | | | |
|---|---|---|---|
| GB | 211792 | A | 2/1924 |
| WO | 9947214 | A1 | 9/1999 |
| WO | 2010089349 | A1 | 8/2010 |

* cited by examiner

RACQUET GRIP TEACHING DEVICE

CROSS-REFERENCE TO RELATED APPLICATIONS

This invention claims priority, under 35 U.S.C. §120, to the U.S. Provisional Patent Application No. 62/050,458 to Peter E. Mallet filed on Sep. 15, 2014, which is incorporated by reference herein in its entirety.

BACKGROUND OF THE INVENTION

Field of the Invention

The present invention relates to athletic training devices, specifically a racquet grip teaching device.

Description of the Related Art

In tennis and in all racquet sports such as racquetball and squash, players use several grips (i.e. specifically how the player's hand interfaces with the handle of the racquet). In fact, during the course of playing tennis, one player may constantly make grip adjustments. The particular grip a player uses may vary because of the type of shot to be hit. For example, the serve, volley and overhead are appropriately hit using a continental grip. To hit a forehand or backhand, a player may use a variety of different grips ranging from an eastern to a full western grip.

Regardless of the grip the player chooses to use, the grip of the racquet is the foundation of all tennis shots. How a player holds the racquet influences the angle of the racquet face, where the player must meet the ball in relationship to his or her body, and especially what happens when the impact between the ball and racquet occurs. Failure to properly grip a racquet will result in poorer performance during a game and even small variations in the interface between the players hand and the racquet can result in an improper grip. Additionally, a proper grip is generally not how a player who is learning the game will tend to grip the racquet. Thus a large part of teaching/training is wrapped up in teaching and maintaining proper grips.

In tennis, there are four basic grips: continental, eastern, semi-western and western. Each of these grips has advantages and disadvantages. One of the most important grips for a tennis player to master is the continental grip. The continental grip is one of the most useful grips for a tennis player to learn because it may be used on a variety of shots including the player's serve, overhead, both forehand and backhand volleys and half-volleys as well as the slice forehand and slice backhand ground strokes. The continental grip is particularly useful for a player that serves and volleys because the player may hit the serve, volley and overhead with one grip. Of all of these shots, the serve with a continental grip is one of the most difficult shots to hit and, not surprisingly, the continental serve is one of the most difficult shots for tennis teaching professionals to teach. As many players are learning this shot, they struggle to consistently and correctly serve by using the continental grip in part because the continental grip feels awkward and uncomfortable.

Even if a player invests in private tennis lessons, the implementation of the continental grip while serving is difficult and the tennis player often does not realize that he or she is using the incorrect grip. For example, a tennis player who has initially learned to serve by using an eastern grip may gravitate back toward the use of the eastern grip on his or her serve even after being taught the continental grip serve. As a result, many tennis players struggle to make the change to the continental grip serve which may significantly preclude them from improving the quality of their tennis skills. Similar issues arise when players try to learn continental grip volleys or when players try to learn any other grip that is new to them. Without the consistent and correct practice with the new grip, improvement is difficult.

Some improvements have been made in the field. Examples of references related to the present invention are described below in their own words, and the supporting teachings of each reference are incorporated by reference herein:

U.S. Pat. No. 3,868,110, issued to Jones, discloses a detachable grip for tennis racket handles having finger and hand indentations accommodating different positions of the hand for forehand and backhand strokes.

U.S. Pat. No. 4,664,381, issued to Aaron, discloses a grip for a tennis racket handle, the grip providing guides for proper gripping techniques and tending to discourage improper gripping techniques. A projection extends from the bottom of the handle to receive the forefinger both to place the forefinger and to provide a trigger for leverage in striking a ball. The side of the handle has a curved ridge, the rearward edge of which defines a thumb recess and the forward edge of which defines a trigger for a backhand grip. A knob rearwardly of the thumb recess defines the rear of the recess without obstructing other gripping techniques. A butt ridge provides a sufficient ridge to give the player a sure grip on the racket. The grip may be symmetrical, so the same grip can be used for both left-hand and right-hand gripping techniques.

U.S. Pat. No. 7,276,000, issued to Baker, discloses a training grip that can be installed onto a tennis racquet handle for positioning a tennis player's hand or hands correctly on the racquet to teach or train the player individual tennis strokes. The training grip is adapted to be easily and removably installed onto the eight-sided handle of a tennis racquet directly over an existing grip that is permanently affixed to the racquet. The training grip is an elongated cup having a slit that runs lengthwise from the first end of the grip to the opposing second end of the grip and through the bottom of the grip through which the grip may be installed onto the racquet handle. The outer surface of the grip is molded to have ridges and depressions creating contours for receiving and positioning the player's fingers and thumbs of the player's hand or hands. The grip is used to teach or train the player on the proper hand positioning for various methods of holding the tennis racquet commonly used to achieve various tennis strokes including the Continental Forehand, the Semi-Western Forehand, the Western Forehand, the Eastern Backhand, and the Two-Handed Backhand.

U.S. Pat. No. 7,758,455, issued to Thomas, discloses a training grip for a tennis racket. The training grip has a series of protrusions and recesses that receive a user's hand and place it in proper position for a particular grip type. The present invention, in one embodiment, includes a universal training grip that allows the grip to be used for more than one grip type. The present invention includes methods, systems and kits that encompass such a tennis training grip.

U.S. Pat. No. 7,896,762, issued to Schroeder, discloses a grip trainer for positioning a user's hand on a sports racquet includes a base configured to be removably attached to the sports racquet handle in a plurality of different positions that correspond to different grips related to the sport for which the racquet is designed for use, a finger positioning device that includes a generally cylindrical projection extending upwardly from the base and configured to position the user's hand on the racquet handle in one of the plurality of positions. A method of positioning a user's hand in any of the forehand, backhand, and service position on a tennis racquet also is disclosed.

The inventions heretofore known suffer from a number of disadvantages which include being difficult to use, being cumbersome to use, being uncomfortable, being limited in use, being inconsistent, being limited in application, being unduly complex, being expensive, being difficult to apply to a racquet/handle, requiring straps and/or tie-downs, failing to remain in place during use, being difficult to install/apply, separating too large a portion of the player's hand from the racquet, changing the feel of the racquet handle too much, failing to fit multiple grip/finger sizes, failing to fit multiple handle/racquet sizes, not being adaptable, failing to force a correct grip, failing to restrict inappropriate movement of the hand with respect to a racquet, failing to allow fingers and thumb movement, being difficult to manufacture, being too heavy, not being durable, blocking the view of the players hand while in operation, being unduly complex to use, being too large, and/or requiring a trainer during use.

What is needed is a racquet grip teaching device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available racquet grip teaching devices. Accordingly, the present invention has been developed to provide a racquet grip teaching device that is easy to use and interchange with a tennis racquet.

According to one embodiment, there is a racquet grip teaching device, that includes one or more of the following: a top clasp that may be shaped and orientated to mate with a racquet handle; a finger guide that may be coupled to the finger connector and or may be shaped to receive a finger; and/or a thumb guide that may be coupled to the top clasp and/or may be shaped to receive a thumb.

According to one embodiment of the invention, there is a racquet (e.g. tennis) grip teaching device that may include a top clasp that may have five faces shaped and orientated to mate with a tennis racquet handle. The top clasp may include a groove between two adjacent interior faces. The top clasp may include exactly five faces. The racquet grip teaching device may include a finger connector that may be extending downwardly from the top clasp at a first end region of the top clasp. The device may include a finger guide that may be disposed at an end of the finger connector, opposite of the top clasp, and may be shaped to receive a finger.

The racquet grip teaching device may include a thumb connector that may be extending downwardly from the top clasp at a second end region, opposite of the first end region. The finger connector may be shorter than the thumb connector. The relative lengths and angular positions of each of the finger connector and thumb connector may be such that during operation, a user's base index knuckle pad and heel of hand pad may be positioned on the same face of the tennis racquet handle. The thumb connector and the finger connector may be angularly spaced apart from each other by about two and a half faces.

The racquet grip teaching device may include a thumb guide that may be disposed at an end of the thumb connector, opposite the top clasp, and may be shaped to receive a thumb; wherein at least one of the finger connector or thumb connector bridges two adjacent faces of the top clasp.

According to one embodiment of the invention, there is a racquet grip teaching kit that may include a pair of racquet grip teaching devices. The racquet grip teaching devices may include a top clasp that may have five faces shaped and may be orientated to mate with a tennis racquet handle. The device may include a finger connector that may be extending downwardly from the top clasp at a first end region of the top clasp. The racquet grip teaching device may include a finger guide that may be disposed at an end of the finger connector, opposite of the top clasp, and may be shaped to receive a finger. The device may include a thumb connector that may be extending downwardly from the top clasp at a second end region, opposite of the first end region. The racquet grip teaching device may include a thumb guide that may be disposed at an end of the thumb connector, opposite the top clasp, and may be shaped to receive a thumb.

The racquet grip teaching kit may include a pair of elongated racquet grip teaching devices that may have a top clasp that may include five faces shaped and orientated to mate with a tennis racquet handle. A single face of the five faces may include a wider face. The elongated racquet grip teaching device may include a finger connector that may be extending downwardly from the top clasp at a first end region of the top clasp. The elongated racquet grip teaching device may include a finger guide that may be disposed at an end of the finger connector, opposite of the top clasp, and may be shaped to receive a finger. The elongated racquet grip teaching device may include a thumb connector that may be extending downwardly from the top clasp at a second end region, opposite of the first end region. The elongated device may include a thumb guide that may be disposed at an end of the thumb connector, opposite the top clasp, and may be shaped to receive a thumb.

The kit may include at least one of the finger connector or thumb connector that bridges two adjacent faces of the top clasp. The top clasp may include a groove between two adjacent interior faces. The top clasp may include exactly five faces. The finger connector may be shorter than the thumb connector. The relative lengths and angular positions of each of the finger connector and thumb connector may be such that during operation, a user's base index knuckle pad and heel of hand pad may be positioned on the same face of the racquet handle. The thumb connector and the finger connector may be angularly spaced apart from each other by about two and a half faces.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
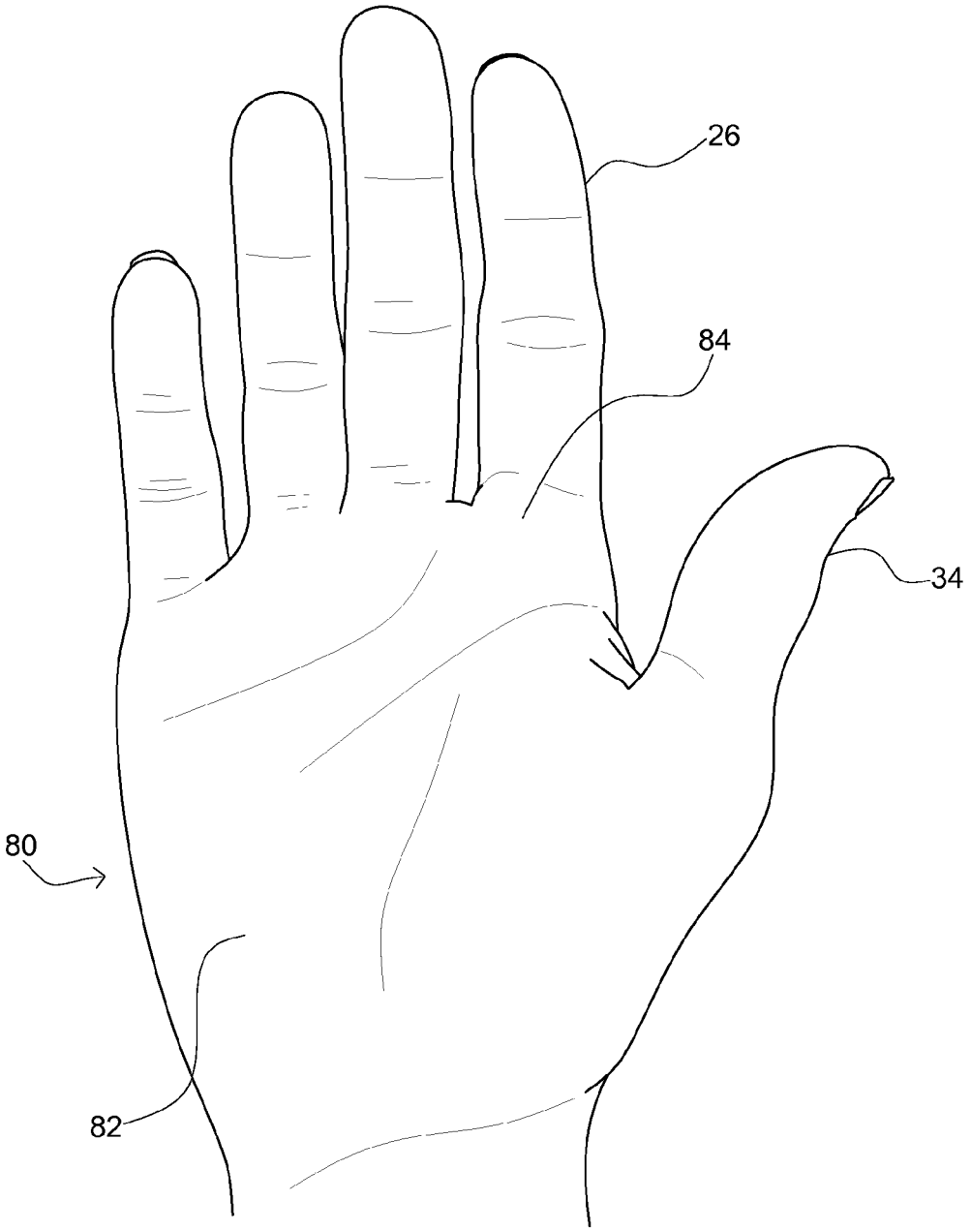
FIG. 1 is a top plan view of a palm of a hand, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a top plan view of a palm of a right hand of a player. There is shown a palm of a hand 80 including an index finger 26 and a thumb 34, wherein the palm 80 includes a heel 82 opposite an underside of a base knuckle 84 of the illustrated index finger 26. The heel 82 and underside 84 are strong and well supported portions of the hand and accordingly play a large role in proper operation of a racquet.

The illustrated hand 80 includes an index finger 26, a thumb 34, a heel 82, and an underside of a base knuckle 84. The palm of the hand 80 is configured to grip a tennis racquet handle, wherein the palm of the hand 80 adjusts and interchanges in between various grips while playing tennis or other racquet sports. The palm of the hand 80 may adjust or interchange in between a continental grip, a western grip, a semi-western grip, and an eastern grip during play. Generally, in each of these grips, the heel 82 and the underside of the base knuckle 84 will rest against the same planar surface of a racquet handle, advantageously providing control and power to the player during use of the racquet.

Figure 2:
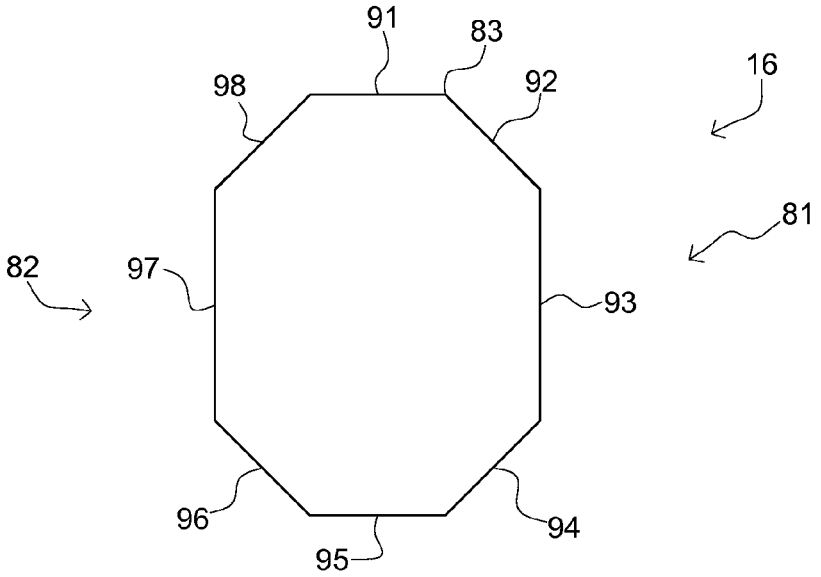
FIG. 2 is a bottom plan view of a tennis racquet handle, according to one embodiment of the invention.

FIG. 2 is a bottom plan view of a tennis racquet handle, according to one embodiment of the invention. Such a structure is also substantially identical to a cross-sectional view of a racquet handle taken along a plane that is parallel to a bottom surface of the racquet handle. Accordingly, herein the illustrated structure will refer both to the "sides" of the bottom of the handle interchangeably with the "sides" of the body of the handle where a hand would generally grip the same even though the bottom of the handle is generally slightly larger than a cross-section of the body. There is shown a tennis racquet handle 16 including eight sides as is typical and customary with such handles. Specifically, two of the eight sides are slightly wider than the other side sides and such wider sides are opposite to each other.

Racquet handle panel numbering is generally described in the context of being right-handed or left-handed. The following description will be given in the terms of right-handed racquet grips. In particular, the eight sides are generally numbered 1-8 starting with side one 91 and going clockwise to side two 92, to side three 93, to side four 94, to side five 95, to side six 96, to side seven 97 and finally resulting in side eight 98 which is adjacent to side one 91. There are two hitting sides/faces of the racquet, the forehand hitting side 82 and the backhand hitting side 81, which are each the sides of the racquet that are facing the ball when the ball is hit. At the boundary between each adjacent side is an edge, e.g. there is an edge between sides one and two which may be identified as the first edge 83 or the one-two edge. Side three 93 is generally associated with the back-hand hitting side 81 and side seven 97 is generally associated with the forehand hitting side 82. Side three 93 and side seven 97 are substantially parallel to the racquet head and are slightly wider than the other sides. This asymmetry in side width advantageously makes it easy for a player to easily and quickly recognize the radial orientation of the racquet head by feel alone. Wherein a handle is left-handed, the numbering one to eight progresses counter-clockwise about the handle instead of clockwise. Accordingly, in a left-handed context, the sides would be as follows: side one 91 and going counter-clockwise to side two 98, to side three 97, to side four 96, to side five 95, to side six 94, to side seven 93 and finally resulting in side eight 92 which is adjacent to side one 91 (with side three 97 being the backhand hitting side and side seven 93 being the forehand hitting side).

Figure 4:
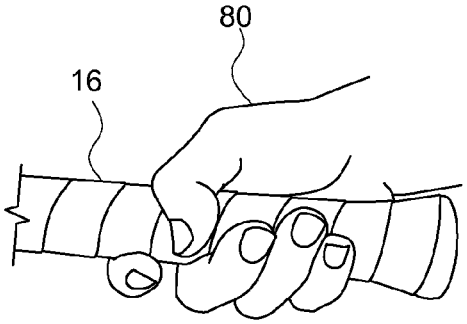
FIG. 4 is a side elevational view of a hand gripping a tennis racquet handle, according to one embodiment of the invention.
Figure 3:
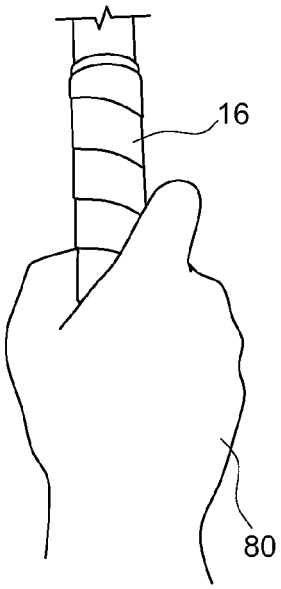
FIG. 3 is a top perspective view of a hand gripping a tennis racquet handle, according to one embodiment of the invention.

Tennis racquet grips generally require that the heel of the palm and the underside of the base knuckle of the index finger (the heel and underside are collectively referred to herein as the "pads") be pressed against the same side as each other (See FIGS. 1, 3 and 4). Since a racquet is front-back symmetrical (i.e. it does not matter which side of the racquet head is used to strike the ball), there are essentially four usable panels (one through four) of a tennis racquet handle, which then correspond to eight total possible grips, in the general sense of the word grip, (four forehand grips and four backhand grips) wherein the pads are both pressed against the same side/panel of the handle but which face of the racquet is hitting the ball changes.

Not all of these grips are regularly taught as some grips are more useful than others. In particular, there are five commonly taught right-handed grips (and therefore five left-handed versions of the same), specifically: the grip known as the eastern backhand grip has the pads on side one 91 and is associated with a backhand swing, the grip known as the continental grip has the pads on side two 92 and is associated with a forehand hit and with a backhand hit (thus as described herein includes two grips that have the same name), the grip known as the eastern forehand grip has the pads on side three 93 and is associated with a forehand hit (the backhand version is not generally taught), the grip known as the semi-western forehand grip has the pads on side four 94 and is associated with a forehand hit (the backhand version is not generally taught), the grip known as the full western forehand grip is generally taught as having the pads on side five 95 and is associated with a forehand hit though due to the symmetry of the handle this is essentially the same as being on side one 91 but being a forehand swing instead of the a backhand swing (i.e. the eastern backhand grip) and therefore for purposes of this description will be referred to interchangeably as pads being on side one 91 or side five 95.

If the clockwise counting method for right-handed grips is used and the counterclockwise counting method for left-handed grips is used, then the above pad designations work equally well for recognizing both right and left-handed grips. Further, there are two-handed grips which are generally a combination of two of the above mentioned grips (or slight variations thereof), wherein the pads of each hand (i.e. the pads within a pad pair) are still each on the same side, though the pad pair of one hand will generally be on a different side from the pad pair of the other hand. As a non-limiting example, a two-handed backhand grip may include a continental (with the right hand) with pads on side two and an eastern forehand (with the left hand) with pads on side seven.

In an alternative mode of describing the sides, the illustrated handle 16 includes a plurality of sides or panels, wherein there is a top side or panel, a left diagonal side or panel and a right diagonal side extending diagonally downwardly from opposite ends of the top side or panel. The handle 16 includes a left vertical side or panel extending downwardly from an end of the left diagonal side or panel, opposite of the top side or panel. The handle 16 includes a right vertical side or panel extending downwardly from an end of the right diagonal side or panel, opposite of the top side or panel. The handle 16 includes a bottom side or panel that is disposed directly opposite of the top side or panel, and is a mirror image thereof. The handle 16 includes a lower right diagonal side or panel extending from the right vertical side or panel and coupling to the bottom side or panel; wherein the lower right diagonal side or panel is a mirror image of the right diagonal side. The handle 16 includes a lower left diagonal side or panel extending from the left vertical side or panel and coupling to the bottom side or panel; wherein the lower left diagonal side or panel is a mirror image of the left diagonal side.

FIG. 3 is a top perspective view of a hand gripping a tennis racquet handle, according to one embodiment of the invention; and FIG. 4 is a side elevational view of a hand gripping a tennis racquet handle, according to one embodiment of the invention. Each is showing a hand 80 gripping a tennis racquet handle 16.

The illustrated hand 80 is gripping a tennis racquet handle 16 using a proper grip, wherein the pads are pressed against the same side/panel/face. The sides are not differentiated in FIGS. 3 and 4 in order to allow for focus on the hand position. Specifically, it may be seen that the thumb and index finger of the hand 80 forms a V-shape with the first segment of the thumb and the index finger being generally in the same plane, when disposed on the tennis racquet handle 16 in a proper grip.

Advantageously, when using a proper grip, a player will have more control and power over the swing and therefore over the movement/placement of the ball. However, a proper grip is generally not the "easiest" way to hold the racquet and therefore it is common, especially among those first learning to play, to readjust ones grip during play to a grip that is improper without realizing it.

Figure 5:
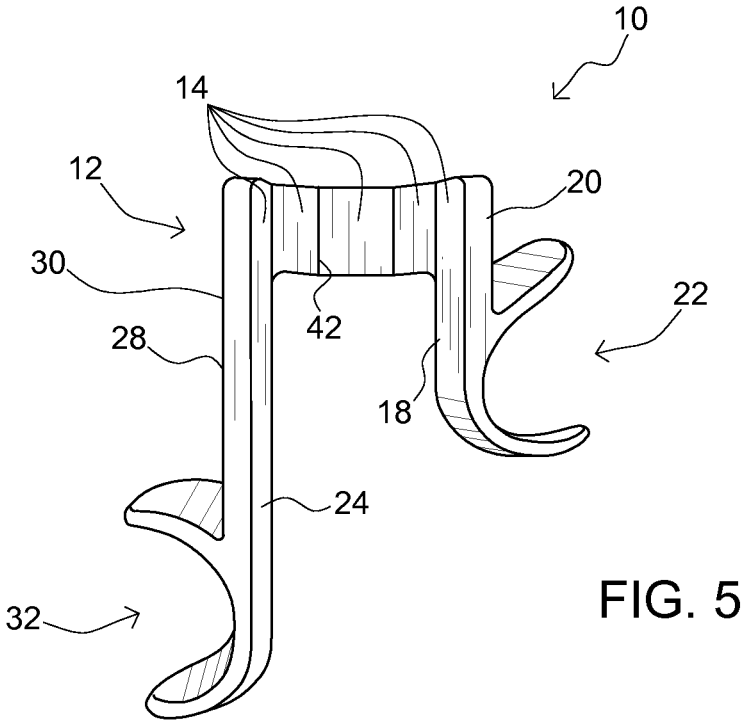
FIG. 5 is a rear elevation view of a racquet grip teaching device, according to one embodiment of the invention.
Figure 6:
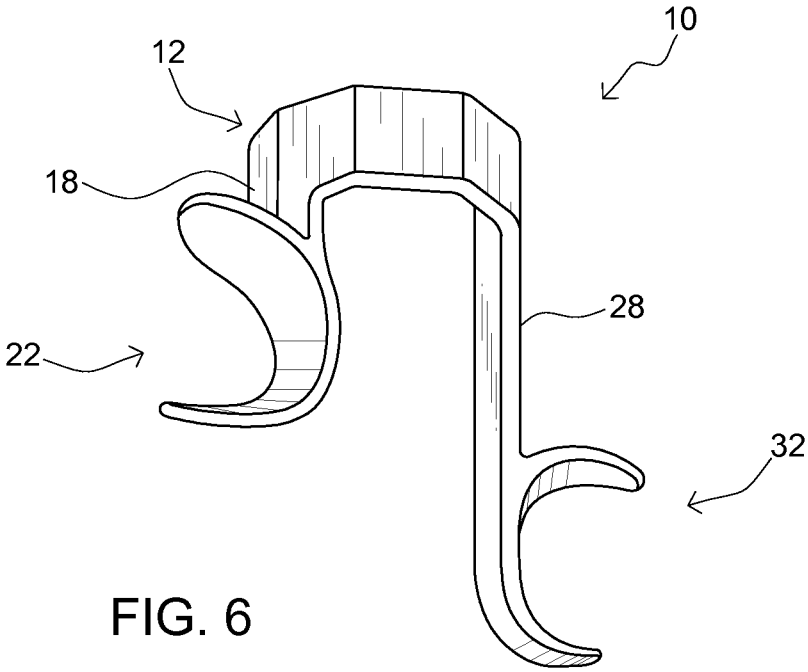
FIG. 6 is a front elevational view of a racquet grip teaching device, according to one embodiment of the invention.

FIG. 5 is a rear elevation view of a racquet grip teaching device, according to one embodiment of the invention and FIG. 6 is a front elevational view of a racquet grip teaching device, according to one embodiment of the invention. There is shown a racquet grip teaching device 10 including a top clasp 12 having five sides 14, a finger connector 18 that extends downwardly from the top clasp, a finger guide 22 at a far end of the finger connector, a thumb connector 28 that extends downwardly from the top clasp, and a thumb guide 32 at a far end of the thumb connector. Advantageously, the device may wrap about and be coupled to a tennis racquet handle and includes placement guides for each of the thumb and forefinger of a player's hand that force a specific position and orientation of each, thereby forcing proper placement of the pads.

The illustrated racquet grip teaching device 10 selectably couples to a tennis racquet handle or any other racquet type device handle to improve grip coordination, memory, and/or muscle memory. The racquet grip teaching device 10 includes a top clasp 12 having five faces shaped and orientated to mate with a tennis racquet handle. The top clasp 12 includes a groove 42 between two adjacent interior faces. The illustrated top clasp 12 includes exactly five faces and includes at least three faces.

Advantageously, a device 10, especially where it is flexible and/or includes grooves, may be coupled to a racquet handle at varying face-sets (i.e. may be removed, rotated about the handle and then attached at a different spot) and thereby a single device 10 may allow for a user to learn a plurality of grips without the need for many devices. This advantageously reduces the inventory that must be carried and reduces the space taken up by the device(s) during shipping, storage, sales, and use. As a non-limiting example, a single device 10 may be used to teach a continental grip and then, when rotated about the handle, used to teach a semi-western grip.

The racquet grip teaching device 10 includes a finger connector 18 extending downwardly from the top clasp 12 at a first end region 20 of the top clasp 12.

The illustrated device 10 includes a finger guide 22 disposed at an end of the finger connector 18, opposite of the top clasp 12, and may be shaped to receive a finger 26 (See FIG. 1). The illustrated finger connector 18 extends from the top clasp such that it bridges across two exterior sides of the top clasp and therefore across two exterior sides of a handle of a racquet.

The illustrated racquet grip teaching device 10 includes a thumb connector 28 extending downwardly from the top clasp 12 at a second end region 30, opposite of the first end region 20. The illustrated finger connector 18 is shorter than the thumb connector 28. The thumb connector 28 and the finger connector 18 are angularly spaced apart from each other by about two and a half faces/sides of the top clasp. The illustrated thumb connector 28 is disposed flush upon an exterior side, opposite of the finger connector 18, of a tennis racquet handle. The thumb connector 28 is disposed parallel to an exterior side, opposite of the finger connector 18, of a tennis racquet handle. The racquet grip teaching device 10 includes a thumb guide 32 disposed at an end 24 of the thumb connector 28, opposite the top clasp 12, and shaped to receive a thumb 34 (See FIG. 1).

The illustrated device helps players to find and keep a correct grip on a racquet. People tend to adjust to bad/improper grips and this device will help them maintain a proper grip during use. Keeping a proper grip for extended periods of practice develops muscle memory and also establishes a "feel" for a proper grip, changing the player so that the proper grip feels easier and more correct as opposed to a predisposition to an improper grip. The device puts the thumb and forefinger of the player in a place such that, since the thumb and forefinger have predefined relationships to the pads, the pads will be properly placed on the correct side/panel of the racquet handle.

In the illustrated embodiment, each of the thumb and finger connectors extend downwardly from the top clasp at opposite locations about the top clasp and each terminate in the thumb and finger guides respectively. The clasp includes grooves that are spaced about an interior surface of the top clasp at regions between the sides thereof that mate with the sides of the racquet handle. The top clasp has five sides which produce a clasp that grips opposite sides of the racquet handle. The two connectors are spaced apart from each other by about 2.5 sides/panels/faces on the top clasp, since one connector extends from a first end side of the top clasp and is substantially planar thereto, while the opposite connector extends from a second end side opposite the first end side but also bridges the side adjacent the second end side so it is not substantially planar to the second end side.

Accordingly, if one connector extends from side one of the top clasp, the other connector extends from sides four and five of the top clasp, with sides two, three and part of side four being therebetween. While FIGS. 5 and 6 illustrate the finger connector straddling two sides/faces/panels of the top clasp, it may be that the finger connector extends from only one side, while the thumb connector straddles two sides/faces/panels. The thumb and finger connectors are sized and shaped such that the pads of the hand will be pressed against the same side/face/panel of the racquet handle. In practice, this generally means that the thumb connector will be approximately the same length as the distance from the bottom of the top clasp to the bottom of the finger guide (See FIG. 7, 46).

However, the exact range of length of the thumb connector is determined by the length of the finger connector, the length of the finger guide, the degree to which one connector or the other straddles two sides, the lengths of the sides of the top clasp, the length of the thumb guide and the angular orientations of each of the thumb and finger guides. Further, adjustments may also be made in determining lengths of the connectors and sizes and orientations of the guides wherein hands of a typical shapes/sizes are to be accommodated. Again, such will be selected so that the pads of the player's hands will tend to rest pressing against the same sides of the racquet handle, wherein standard grips are desired (if non-standard grips are desired, e.g. to force a handicap/difficulty on a player, such may be selected to vary from that as appropriate).

According to one embodiment of the invention, there is a racquet grip teaching device/kit, that includes: a top clasp that shaped and orientated to mate with a racquet handle; a finger guide coupled to the finger connector and shaped to receive a finger; and a thumb guide coupled to the top clasp and shaped to receive a thumb. The top clasp may be a band having faces as illustrated, may be a clip, may be a connector, may be a biased member, may include a contact adhesive for coupling to a racquet handle, may be a spiral clasp that wraps up a racquet handle, may clasp in front of the racquet instead of behind as illustrated, or combinations thereof.

Figure 7:
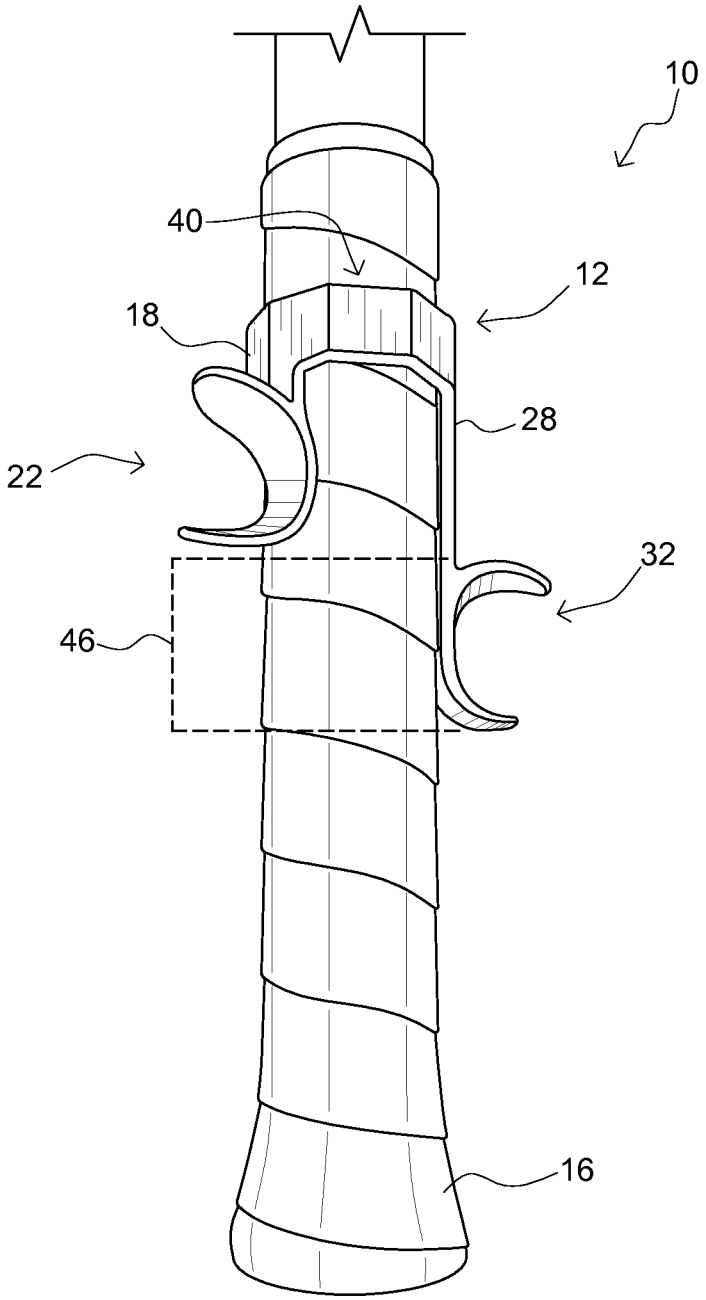
FIG. 7 is front perspective view of a racquet grip teaching device selectably coupled to a tennis racquet handle, according to one embodiment of the invention.

FIG. 7 is front perspective view of a racquet grip teaching device selectably coupled to a tennis racquet handle, according to one embodiment of the invention. There is shown a racquet grip teaching device 10 including a top clasp 12, a finger connector 18, a finger guide 22, a thumb connector 28, and a thumb guide 32.

The illustrated racquet grip teaching device 10 selectably couples to a tennis racquet handle 16. The racquet grip teaching device 10 includes a top clasp 12 having five faces shaped and orientated to mate with a tennis racquet handle 16. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (see FIG. 1).

The racquet grip teaching device 10 includes a thumb connector 28 extending downwardly from the top clasp 12 at a second end region 30, opposite of the first end region 20. The illustrated finger connector 18 is shorter than the thumb connector 28, as shown by element number 40. The relative lengths and angular positions of each of the finger connector 18 and thumb connector 28 is such that during operation, a user's base index knuckle pad and heel of hand pad are positioned on the same face (i.e. panel) of the tennis racquet handle. As used herein, the phrase "heel of hand pad" does not include the entire heel of the hand, but is limited to the pad on the heel that is diagonally opposite the base index knuckle pad and is not the pad at the base of the thumb. In tennis instruction, this portion of the hand is generally referred to as the "heel of hand."

The racquet grip teaching device 10 includes a thumb guide 32 disposed at an end of the thumb connector 28, opposite the top clasp 12, and shaped to receive a thumb 34 (See FIG. 1). At least one of the finger connector 18 or thumb connector 28 bridges two adjacent faces of the top clasp 12.

Figure 8:
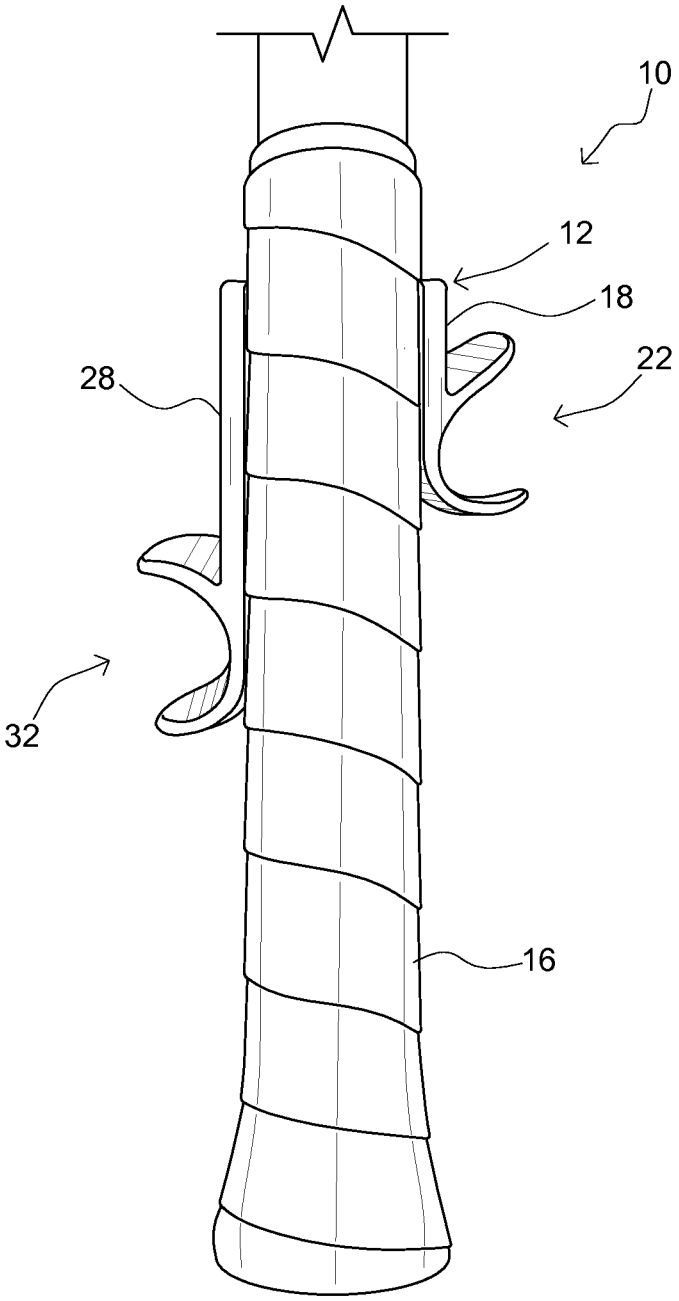
FIG. 8 is a rear perspective view of a racquet grip teaching device selectably coupled to a tennis racquet handle, according to one embodiment of the invention.

FIG. 8 is a rear perspective view of a racquet grip teaching device selectably coupled to a tennis racquet handle, according to one embodiment of the invention. There is shown a racquet grip teaching device 10 including a top clasp 12, a finger connector 18, a finger guide 22, a thumb connector 28, and a thumb guide 32.

The illustrated racquet grip teaching device 10 selectably couples to a tennis racquet handle 16. The racquet grip teaching device 10 includes a top clasp 12 having five faces shaped and orientated to mate with a tennis racquet handle 16. The racquet grip teaching device 10 is configured to be selectably rotatably coupled to the tennis racquet handle 16 to provide a desired orientation and positioning for a particular tennis grip. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (See FIG. 1).

The racquet grip teaching device 10 includes a thumb connector 28 extending downwardly from the top clasp 12 at a second end region 30, opposite of the first end region 20. The finger connector 18 is shorter than the thumb connector 28. The racquet grip teaching device 10 includes a thumb guide 32 disposed at an end of the thumb connector 28, opposite the top clasp 12, and shaped to receive a thumb 34 (See FIG. 1).

Figure 9:
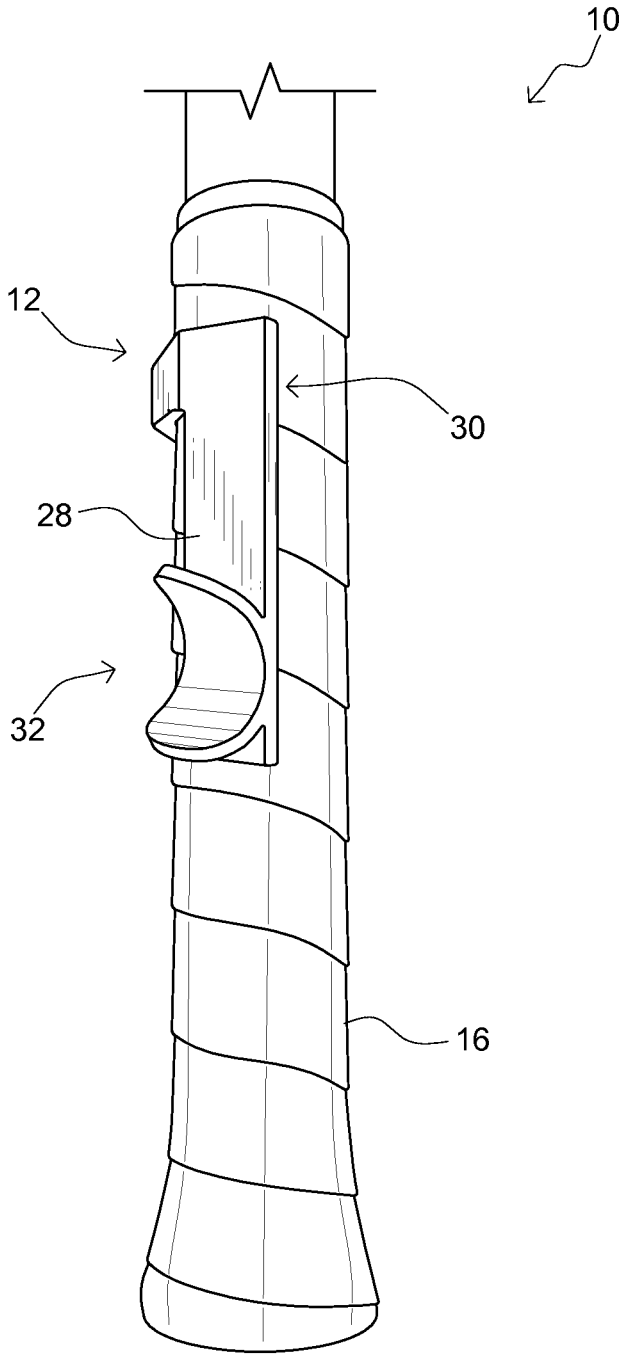
FIG. 9 is a right side perspective view of a racquet grip teaching device selectably coupled to a tennis racquet handle, according to one embodiment of the invention.

FIG. 9 is a right side perspective view of a racquet grip teaching device selectably coupled to a tennis racquet handle, according to one embodiment of the invention. There is shown a racquet grip teaching device 10 including a top clasp 12, a thumb connector 28, and a thumb guide 32. Not illustrated in FIG. 9 are the finger guide and finger connector as they are obscured by the racquet handle.

The illustrated racquet grip teaching device 10 selectably couples to a tennis racquet handle 16. The racquet grip teaching device 10 includes a top clasp 12 having five faces shaped and orientated to mate with a tennis racquet handle 16; wherein a standard tennis racquet includes eight sides. The top clasp 12 is configured to couple to half of the tennis racquet handle 16 and secure thereto. The top clasp 12 includes a groove between two adjacent interior faces. The top clasp 12 includes exactly five faces. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (See FIG. 1).

The racquet grip teaching device 10 includes a thumb connector 28 extending downwardly from the top clasp 12 at a second end region 30, opposite of the first end region 20. The racquet grip teaching device 10 includes a thumb guide 32 disposed at an end of the thumb connector 28, opposite the top clasp 12, and shaped to receive a thumb 34 (See FIG. 1). The finger guide 22 and the thumb guide 32 are designed to securely support a finger and a thumb when pressure is applied to the finger guide and the thumb guide during use. Typically, the pressure applied to the finger guide and the thumb guide counter-balance each other, thereby providing a firm grip on the tennis racquet handle. The pressure applied by the thumb is applied to the tennis racquet handle, thereby providing a tighter grip.

Figure 10:
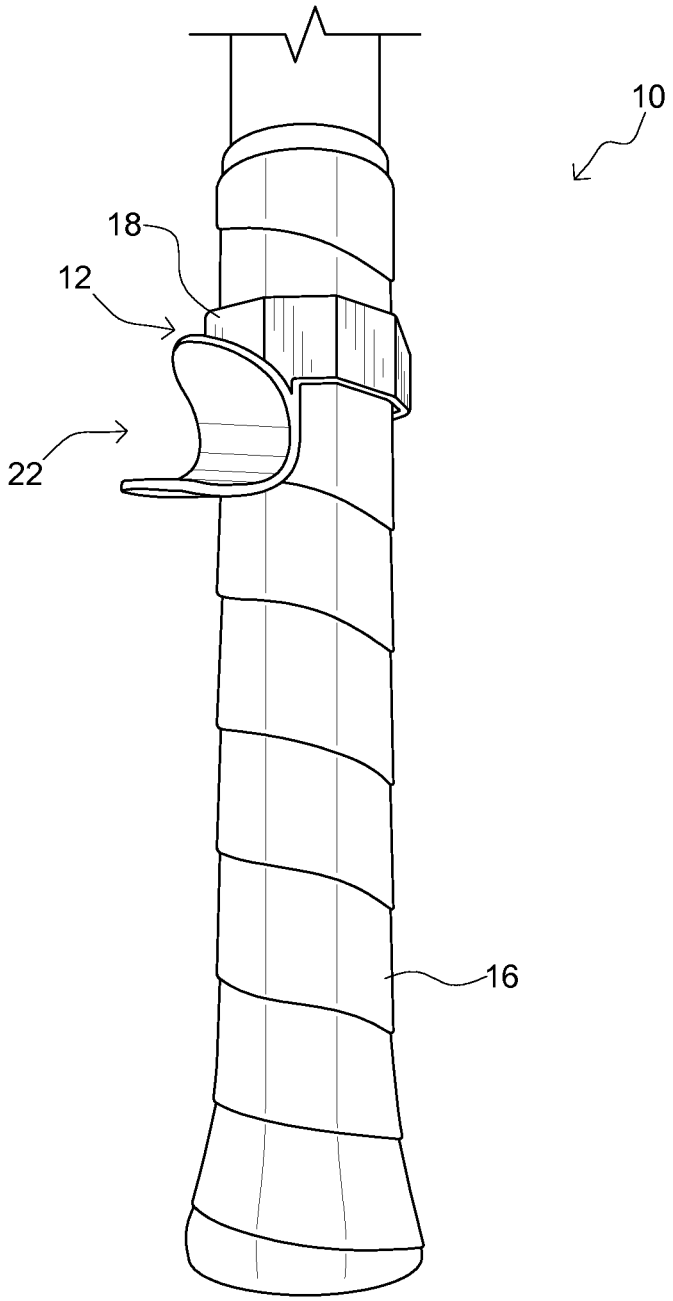
FIG. 10 is a left side perspective view of a racquet grip teaching device selectably coupled to a tennis racquet handle, according to one embodiment of the invention.

FIG. 10 is a left side perspective view of a racquet grip teaching device selectably coupled to a tennis racquet handle, according to one embodiment of the invention. There is shown a racquet grip teaching device 10 including a top clasp 12, a finger connector 18, and a finger guide 22. Not illustrated in FIG. 10 are the thumb guide and thumb connector as they are obscured by the racquet handle.

The illustrated racquet grip teaching device 10 selectably couples to a tennis racquet handle 16. The racquet grip teaching device 10 includes a top clasp 12 having five faces shaped and orientated to mate with a tennis racquet handle 16. The top clasp 12 includes a groove between two adjacent interior faces. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (See FIG. 1). The finger guide 22 provides support to a finger, when in use; wherein an index finger applies pressure upon the finger guide, and thereby providing a firm grip.

The racquet grip teaching device 10 includes a thumb connector 28 extending downwardly from the top clasp 12 at a second end region 30, opposite of the first end region 20. The finger connector 18 is shorter than the thumb connector 28. The racquet grip teaching device 10 includes a thumb guide 32 disposed at an end of the thumb connector 28, opposite the top clasp 12, and shaped to receive a thumb 34 (see FIG. 1).

Figure 11:
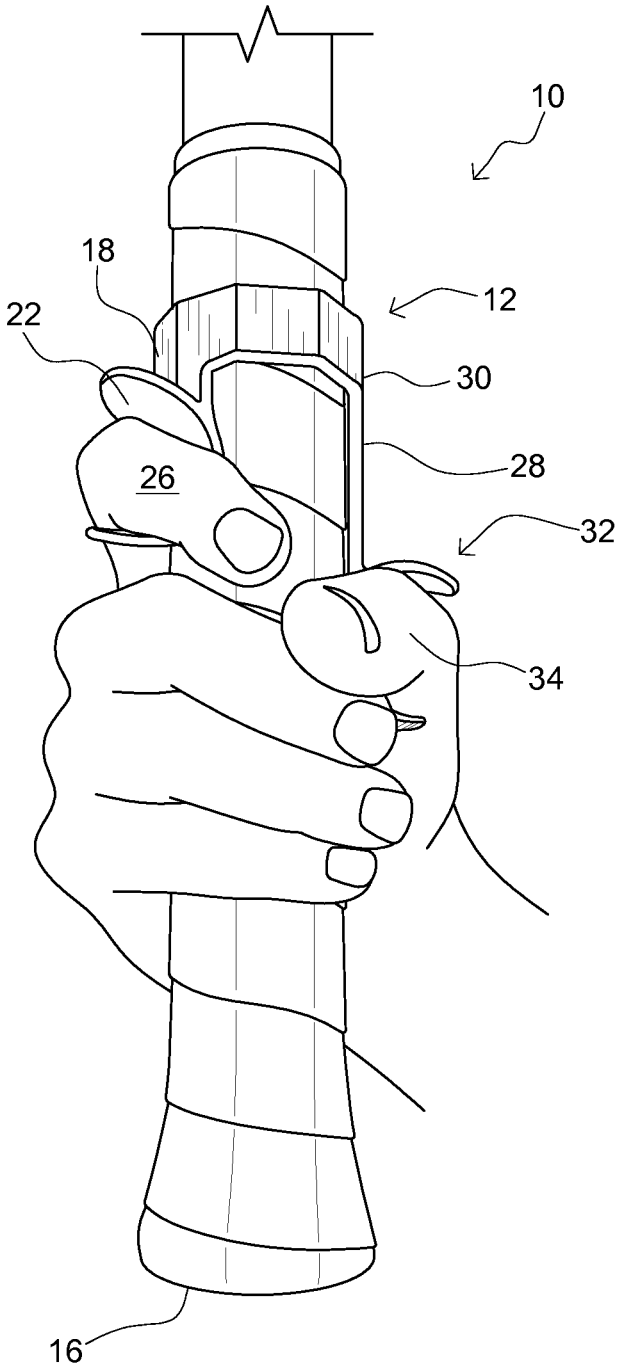
FIG. 11 is a side perspective view of a hand gripping a racquet grip teaching device selectably coupled to a tennis racquet handle, according to one embodiment of the invention.

FIG. 11 is a side perspective view of a hand gripping a racquet grip teaching device selectably coupled to a tennis racquet handle, according to one embodiment of the invention. There is shown a racquet grip teaching device 10 including a top clasp 12, a finger connector 18, a finger guide 22, a thumb connector 28, and a thumb guide 32.

The illustrated racquet grip teaching device 10 selectably couples to a tennis racquet handle or any other tennis racquet type device handle to improve grip coordination, memory, and/or muscle memory. The racquet grip teaching device 10 includes a top clasp 12 having five faces shaped and orientated to mate with a tennis racquet handle. The top clasp 12 includes a groove between two adjacent interior faces. The top clasp 12 includes exactly five faces. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (See FIG. 1).

The racquet grip teaching device 10 includes a thumb connector 28 extending downwardly from the top clasp 12 at a second end region 30, opposite of the first end region 20. The finger connector 18 is shorter than the thumb connector 28. The relative lengths and angular positions of each of the finger connector 18 and thumb connector 28 is such that during operation, a user's base index knuckle pad and heel of hand pad are positioned on the same face of the tennis racquet handle. The thumb connector 28 and the finger connector 18 are angularly spaced apart from each other by about two and a half faces.

The racquet grip teaching device 10 includes a thumb guide 32 disposed at an end of the thumb connector 28, opposite the top clasp 12, and shaped to receive a thumb 34 (See FIG. 1). At least one of the finger connector 18 or thumb connector 28 bridges two adjacent faces of the top clasp 12.

Figure 12:
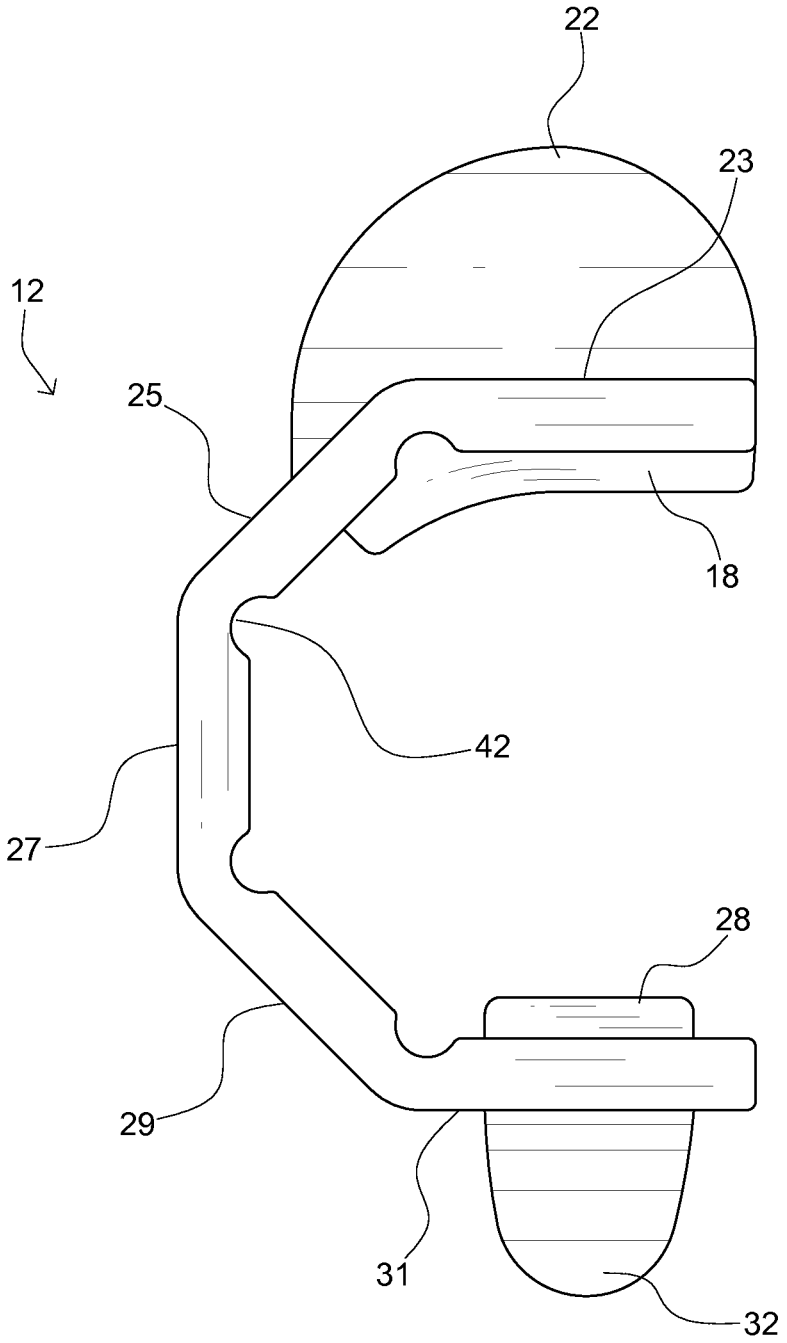
FIG. 12 is a right side perspective view of a racquet grip teaching device selectably coupled to a tennis racquet handle, according to one embodiment of the invention.

FIG. 12 is a top view of a racquet grip teaching device, according to one embodiment of the invention. There is shown a racquet grip teaching device 10 including a top clasp 12, a finger connector 18, a finger guide 22, a thumb connector 28, and a thumb guide 32.

The top clasp 12 includes five faces 23, 25, 27, 29, and 31 each having a groove 42 therebetween on an interior boundary between each face. The grooves 42 are regions wherein the thickness of the top clasp (i.e. the distance from the exterior surface to the interior surface) is less than the surrounding material such that the grooves 42 form a locus of increased flexibility. This advantageously permits a single device to fit multiple sizes of racquet handles. Typically, there are six adult grip/handle sizes (4, 4 and ⅛, 4 and ¼, 4 and ⅜, 4 and ½, and 4 and ⅝), two junior grip sizes (4, and 3 and ⅞), and two children grip sizes (3 and ½, and 3 and ⅝). Accordingly, instead of requiring an inventory of a total of ten different product sizes for each device, the entire range of sizes may be spanned by two to four devices, thus substantially reducing inventory costs and required storage space and shipping costs.

The illustrated finger connector 18 extends orthogonally from a plane defined by the semi-circle formed by the top clasp and bridges two associated adjacent faces 23 and 25 that are opposite where the thumb connector 28 extends orthogonally from a plane defined by the semi-circle formed by the top clasp in a manner planar to the associated face 31. Accordingly, the thumb and finger guides are separated by approximately 2.5 faces The illustrated racquet grip teaching device 10 selectably couples to a tennis racquet handle or any other tennis racquet type device handle to improve grip coordination, memory, and/or muscle memory. The racquet grip teaching device 10 includes a top clasp 12 having five faces shaped and orientated to mate with a tennis racquet handle. The top clasp 12 includes a groove between two adjacent interior faces. The illustrated top clasp 12 includes exactly five faces. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger 26 (See FIG. 1).

The racquet grip teaching device 10 includes a thumb connector 28 extending downwardly from the top clasp 12 at a second end region 30, opposite of the first end region 20. The finger connector 18 is shorter than the thumb connector 28. The relative lengths and angular positions of each of the finger connector 18 and thumb connector 28 is such that during operation, a user's base index knuckle pad and heel of hand pad are positioned on the same face of the tennis racquet handle. The thumb connector 28 and the finger connector 18 are angularly spaced apart from each other by about two and a half faces.

The racquet grip teaching device 10 includes a thumb guide 32 disposed at an end of the thumb connector 28, opposite the top clasp 12, and shaped to receive a thumb 34 (See FIG. 1). At least one of the finger connector 18 or thumb connector 28 bridges two adjacent faces of the top clasp 12.

Figure 13:
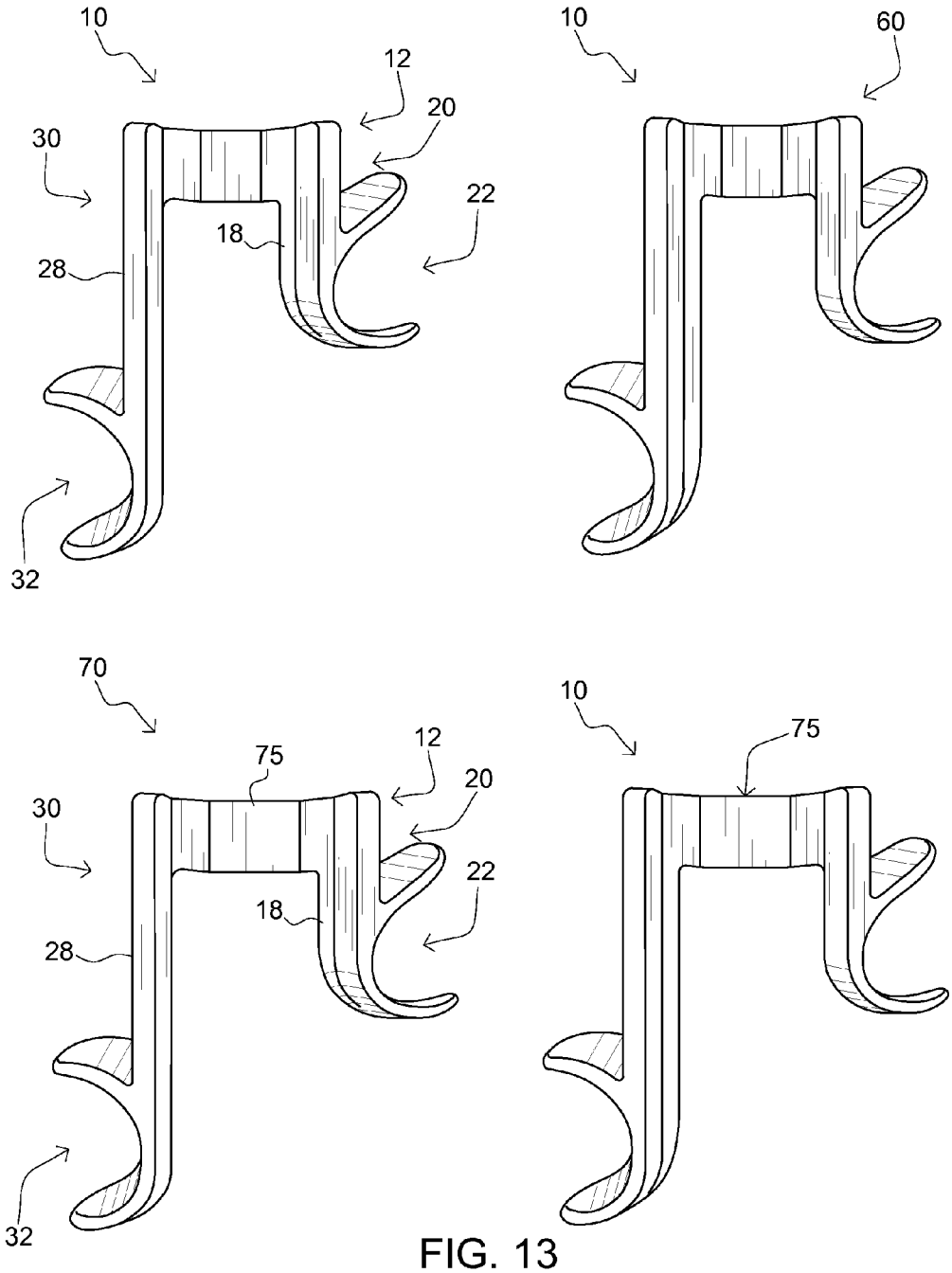
FIG. 13 is a perspective view of a racquet grip teaching kit, according to one embodiment of the invention.

FIG. 13 is a perspective view of a racquet grip teaching kit, according to one embodiment of the invention. There is shown a racquet grip teaching kit 60 including a pair of racquet grip teaching devices 10 and a pair of elongated racquet grip teaching devices 70. The illustrated devices represent a matrix of variation along two binary variables, specifically whether the thumb or finger connector bridges two faces and whether all faces of the top clasp are substantially the same width or if one is wider 75 than the others (accommodating the wider sides three and seven of the racquet in tennis racquets). Accordingly, there is one member of the kit that has a bridging finger connector with all sides the same, one with a bridging thumb connector with all sides the same, one with a bridging finger connector with one side wider, and one with a bridging thumb connector with one side wider. A kit having all four variations will allow for a player to apply at least one device against any side of their racquet and thereby force their pads to be simultaneously against any face/side/panel of the racquet handle. Accordingly, any grip wherein the pads are against the same side is achievable with such a kit. Further, a kit may include a plurality of devices having similar characteristics (i.e. bridging and/or side width) but being of varying overall sizes, shapes, colors, and the like and combinations thereof. Additionally, varying devices may have different colors, markings, shapes, writing, protrusions, embossing and the like and combinations thereof to distinguish one from the other and/or otherwise make it easy to know which device to use for a particular grip.

There is shown a racquet grip teaching kit 60 having a pair of racquet grip teaching devices 10. The illustrated racquet grip teaching device 10 selectably couples to a tennis racquet handle or any other tennis racquet type device handle to improve grip coordination, memory, and/or muscle memory. The racquet grip teaching device 10 includes a top clasp 12 having five faces shaped and orientated to mate with a tennis racquet handle. The top clasp 12 includes a groove between two adjacent interior faces. The illustrated top clasp 12 includes exactly five faces. The racquet grip teaching device 10 includes a finger connector 18 extending downwardly from the top clasp 12 at a first end region 20 of the top clasp 12. The device 10 includes a finger guide 22 disposed at an end of the finger connector 18, opposite of the top clasp 12, and may be shaped to receive a finger.

The racquet grip teaching device 10 includes a thumb connector 28 extending downwardly from the top clasp 12 at a second end region 30, opposite of the first end region 20. The illustrated finger connector 18 is shorter than the thumb connector 28. The thumb connector 28 and the finger connector 18 are angularly spaced apart from each other by about two and a half faces. The thumb connector 28 is disposed flush upon an exterior side, opposite of the finger connector 18, of a tennis racquet handle. The thumb connector 28 is disposed parallel to an exterior side, opposite of the finger connector 18, of a tennis racquet handle. The racquet grip teaching device 10 includes a thumb guide 32 disposed at an end of the thumb connector 28, opposite the top clasp 12, and shaped to receive a thumb.

The illustrated kit 60 includes a pair of elongated racquet grip teaching devices 70 that selectably couples to a tennis racquet handle or any other tennis racquet type device handle to improve grip coordination and memory. The elongated racquet grip teaching device 70 includes a top clasp 12 having five faces shaped and orientated to mate with a tennis racquet handle. The illustrated top clasp 12 of the elongated racquet grip teaching device 70 includes a longer middle face 75, wherein the elongated racquet grip teaching device 70 is configured to couple to a tennis racquet handle in a different position and orientation than the racquet grip teaching device 10; thereby providing interchangeability to other tennis grips for practice. The illustrated top clasp 12 includes exactly five faces. The elongated racquet grip teaching device 70 includes a finger connector 18 extending downwardly from the top clasp 12 at a first end region 20 of the top clasp 12. The elongated device 70 includes a finger guide 22 disposed at an end of the finger connector 18, opposite of the top clasp 12, and may be shaped to receive a finger.

The elongated racquet grip teaching device 70 includes a thumb connector 28 extending downwardly from the top clasp 12 at a second end region 30, opposite of the first end region 20. The illustrated finger connector 18 is shorter than the thumb connector 28. The thumb connector 28 and the finger connector 18 are angularly spaced apart from each other by about two and a half faces. The elongated racquet grip teaching device 70 includes a thumb guide 32 disposed at an end of the thumb connector 28, opposite the top clasp 12, and shaped to receive a thumb.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate relative lengths and sizes of the structures described herein, variations on such are expected to match with varying sizes of associated racquets, varying racquet characteristics (e.g. racquets not used for tennis, racquets having fewer or more than eight panels, having panels all the same size or otherwise not sized as described herein), non-standard racquets, players having hands that substantially vary from typical sizes/shapes, and the like and combinations thereof. Further, while the description herein refers to the connectors as extending "downwardly" from the collar and if the device where to be inverted, such an extension may be then called "upwardly" but still fall within the meaning of the term "downwardly" as used herein since "downwardly" is not defined with respect to gravity or any other specific reference point.

It is expected that there could be numerous variations of the design of this invention. An example is that the device may include ornamentation, branding elements, decorative flourishes and the like.

Further, the top clasp may be shaped to couple to a racquet handle with the assistance of an adhesive, such as but not limited to a contact adhesive.

Finally, it is envisioned that the components of the device may be constructed of a variety of materials, including but not limited to plastics, resins, gums, metals, ceramics, natural fibers, woven fibers, woods, concretes/cements, composite materials and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A racquet grip teaching device, comprising:

a) a top clasp shaped and orientated to mate with a racquet handle, the top clasp being disposed at a top of the racquet grip teaching device and having a plane of orientation defined by five faces of an octagon, wherein the top clasp includes two faces that are longer than three other faces of the octagon;

b) a finger connector disposed below the top clasp and coupled to the racquet grip teaching device by only the top clasp, wherein the finger connector extends downwardly from the top clasp in a direction orthogonal to the plane of orientation of the top clasp;

c) a finger guide at an end of the finger connector shaped to receive and trap a finger d) a thumb connector disposed below the top clasp and coupled to the racquet grip teaching device by only the top clasp, wherein the thumb connector extends downwardly from the top clasp in a direction orthogonal to the plane of orientation of the top clasp and wherein the thumb connector and the finger connector are angularly spaced apart from each other by about two and a half faces of the octagon;

e) a thumb guide at an end of the thumb connector shaped to receive and trap a thumb; and f) a void in the racquet grip teaching device below the top clasp and between the finger connector and the thumb connector.

2. The device of claim 1, wherein the top clasp includes two faces of the octagon defining the top clasp that are parallel to each other and on opposite ends of the top clasp from each other.

3. The device of claim 1, wherein the relative lengths and angular positions of each of the finger connector and the thumb connector are such that during operation a user's base index knuckle pad and heel of hand pad are positioned on the same face of the tennis handle.

* * * * *